United States Patent [19]

Buckner

[11] 4,452,463

[45] Jun. 5, 1984

[54] PACKER SEALING ASSEMBLY

[75] Inventor: Robert K. Buckner, Rowlett, Tex.

[73] Assignee: Dresser Industries, Inc., Dallas, Tex.

[21] Appl. No.: 305,572

[22] Filed: Sep. 25, 1981

[51] Int. Cl.[3] ..... E21B 33/02; B65D 53/00; F16L 21/02

[52] U.S. Cl. ..... 277/120; 277/188 A; 166/196; 251/1 B

[58] Field of Search ..... 277/188 A, 117, 119, 277/34, 120, 34.3, 121, 122, 116.2, 116.4, 116.6, 188 R; 166/134, 196; 251/1 B

[56] References Cited

U.S. PATENT DOCUMENTS

| | | | |
|---|---|---|---|
| 1,347,351 | 7/1920 | Murray et al. | 277/188 R |
| 1,381,931 | 6/1921 | Ostrander | 277/188 R X |
| 1,836,470 | 12/1931 | Humason et al. | 277/34 X |
| 2,494,598 | 1/1950 | Waring | 277/188 R |
| 3,109,493 | 11/1963 | Carter | 277/116.2 |
| 4,326,588 | 4/1982 | McStravick | 277/188 A X |

*Primary Examiner*—Stuart S. Levy
*Assistant Examiner*—Lloyd D. Doigan
*Attorney, Agent, or Firm*—W. R. Peoples

[57] ABSTRACT

A sealing assembly for a packer includes a generally cylindrical elastomeric sealing element telescoped onto a mandrel between upper and lower expander heads. A sealing ring is disposed between each expander head and the sealing element at each end thereof for expanding radially outward toward engagement with the inside wall of a casing to keep the element from extruding between the expander heads and casing when setting the packer. A substantially non-expandable retaining ring surrounds the mandrel adjacent each of said sealing rings and an annular receptacle surrounds the mandrel and is located between each of the expander heads and the opposite ends of the sealing element. The receptacle has inner and outer malleable annular walls which are normally spaced radially outward from the mandrel and an end wall is integrally connected between these inner and outer walls so as to define an annular trough opening toward the sealing element. Extending into the trough is an annular protrusion which is integrally formed with the sealing element in each of the ends thereof so as to deform the inner walls radially inward into sealing engagement with the mandrel against elastomeric extrusion therebetween and so as to deform the outer walls radially outward into sealing engagement with the retaining ring against elastomeric extrusion therebetween when setting the packer.

8 Claims, 4 Drawing Figures

PACKER SEALING ASSEMBLY

TECHNICAL FIELD

This invention relates generally to a packer such as may be used in an oil or gas well to seal off an oil or gas bearing formation and more particularly to the sealing element assembly used in the packer to effect sealing between tubing in the well and the well casing.

BACKGROUND ART

U.S. Pat. Nos. 2,921,632, 3,036,639 and 3,182,614 as well as a copending patent application Ser. No. 204,750, filed Nov. 7, 1980, disclose various forms of packers such as may be used in an oil or gas well in association with other well tools for servicing or preparing a well for production purposes. In such a well, a packer may be used to create a seal against the flow of pressure fluid in the annular space between tubing in the well and the well casing. Various mechanical arrangements are employed in such packers for anchoring the packer at a preselected position vertically in the well and to effect the desired sealing. For example, in the packer disclosed in the aforementioned U.S. Pat. No. 3,036,639, vertically spaced sets of slips mounted on upper and lower expander heads are wedged radially outward to anchor the packer in the well casing by vertical manipulation of a tubular mandrel carrying both the expander heads and the slips. As the expander heads are moved toward each other, a sealing assembly which includes an elastomeric sealing element is squeezed between the expander heads so as to expand radially and seal against the inside wall of the casing. At opposite ends of the sealing element, expandable metallic sealing rings engage the inside wall of the casing so as to keep the elastomeric material in the element from extruding between the expander heads and the casing and thereby reducing the effectiveness of the seal. Between the expander heads and the packer mandrel, close clearance tolerances may be maintained to avoid the loss of elastomeric material.

DISCLOSURE OF THE INVENTION

The present invention aims to provide an improved packer sealing assembly for particularly effective sealing against extrusion of the elastomeric sealing element of the packer between the packer mandrel and the expander head so as to reduce the criticality of the clearance tolerance therebetween. More particularly, the invention resides in the provision of a unique assembly of components in association with the elastomeric sealing element for blocking extrusion of the elastomeric material from the ends thereof, either between the casing and the expander head or between the mandrel and the expander head by providing for metal-against-metal sealing against such extrusion. Specifically herein, the invention resides in construction of the assembly to include a metallic sealing ring which is expandable radially outwardly under packer setting forces, a retaining ring which abuts the sealing ring for causing the latter to expand radially outwardly when such setting force is applied and a sealing receptacle which is formed of a malleable material located between the retaining ring and the mandrel. Advantageously, when setting force is applied, the sealing receptacle expands radially inwardly to seal against the mandrel. Also, the receptacle expands radially outward to seal against the retaining ring.

The foregoing and other important features and advantages of the present invention will become more apparent from the following description of the last mode of the present invention when taken in conjunction with the accompanying drawings.

BEST MODE OF CARRYING OUT THE INVENTION

Figure 1:
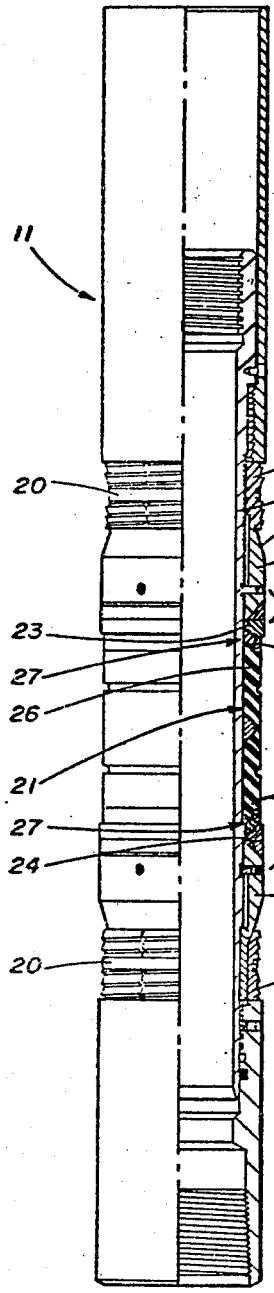
FIG. 1 is a combined elevational and cross-sectional view of a packer incorporating a sealing assembly embodying the novel features of the present invention.
Figure 2:
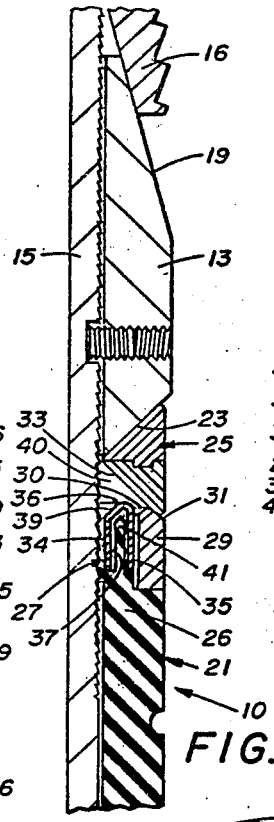
FIG. 2 is an enlarged fragmentary, cross-sectional view of a portion of the exemplary sealing assembly shown prior to setting of the packer.

As shown in the drawings for purposes of illustration, the present invention is embodied in a sealing assembly 10 for an oil well packer 11 or the like. In the packer, the sealing assembly is mounted between upper and lower expander heads 13 and 14 which in turn, are frangibly connected to a tubular mandrel 15. Upper and lower sets of slips 16 and 17 are held in place on frustoconical surfaces 19 of the expander heads by frangible bands 20. As described more particularly in the aforementioned copending application, when setting the packer against the inside wall of the well casing (not shown), the upper set of slips 16 first is anchored in place and then the mandrel 15 is pulled upwardly, breaking the frangible connection of the expander heads 13 and 14 to the mandrel so that they slide toward each other relative to the mandrel. This squeezes an elastomeric sealing element or sleeve 21 located between the two heads causing the sleeve to expand radially outward and seal agaist the casing. Herein, the sleeve 21 is formed of an 80 durometer neoprene although 75 to 90 durometer elastomeric materials also may prove to be satisfactory depending upon application requirements. As shown in FIGS. 1 and 2 the upper and lower expander heads 13 and 14 include facing end surfaces 23 and 24 which are slanted away from each other upon progressing radially outward from the mandrel 15. Expandable metallic sealing rings 25 substantially like those disclosed in the aforesaid U.S. Pat. No. 3,036,639 are positioned in engagement with and between the end surfaces 13 and 14 of the expander heads and the adjacent end portions 26 of the sleeve 21. Thus, as the sleeve and rings expand radially, the rings first engage the inside wall of the casing to seal against the extrusion of the elastomeric material comprising the sleeve between the expander heads 13 and 14 and the casing.

In accordance with the primary aim of the present invention unique annular receptacles 27 are provided in the sealing assembly to keep the sleeve 21 from extruding between the expander heads 13 and 14 and the mandrel 15 without having to maintain close clearance tolerances between the heads and the mandrel. For this purpose, the receptacles 27 are formed of a malleable metal and receive portions of the sleeve so that, as the sleeve is squeezed during setting of the packer slips 16 and 17 some of the elastomeric material of the sleeve flows onto the receptacles, deforming them radially inward toward engagement with the mandrel to seal against extrusion of elastomeric material between the mandrel and the expander heads at both ends of the sleeve 21. By virtue of this arrangement, the close clearance tolerances otherwise required to prevent such extrusion between the expander head and the mandrel are avoided.

In the present instance, two of the receptacles 27 are utilized in the sealing assembly 10 (see FIG. 1), one adjacent each of the upper and lower expander heads 13 and 14. The upper and lower ends of the sealing assembly are substantially identical in function and configuration and thus only one will be described in detail hereinafter, it being appreciated that such description applies equally well to either end of the sealing assembly.

Figure 3:
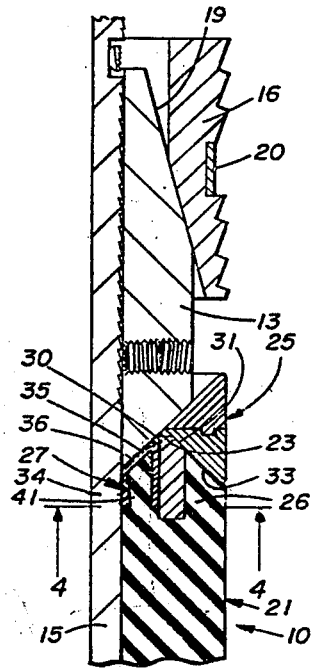
FIG. 3 is a view similar to FIG. 2 but showing parts of the assembly in moved positions as if the packer were set.

Preferably, but not necessarily so, the exemplary sealing assembly 10 includes a non-expandable, annular, retaining ring 29 (see FIG. 2) disposed between the sealing ring 25 and the upper end 26 of the elastomeric sleeve 21. When setting the packer, the retaining ring slides upwardly on the mandrel 15 relative to the upper expander head 13 and the sealing ring 25 is cammed radially outward by sliding across the end face 23 of the expander head. Herein, the upper end of the retaining ring includes inner and outer chamfered surfaces 30 and 31 (see FIGS. 2 and 3) slanted at substantially the same angles as the end face 23 of the expander head and the lower surface 33 of the sealing ring, respectively. By virtue of this structural configuration, when the packer is set, the junctural faces 23, 30 and 33 of the expander head, the sealing ring and the retaining ring are directed into positions minimizing the extend of unfilled space between the expander head and the retaining ring.

Located radially inward of the retaining ring 29 is the receptacle 27 which, in the present instance, comprises inner and outer annular walls 34 and 35 interconnected by an integral upper end wall 36 so as to form a downwardly opening trough 37. Herein, the end wall includes a section 39 (FIG. 2) which is slanted upwardly upon progressing radially outward from the inner wall 34 at an angle which is the same as the slanted end face 23 of the adjacent expander head 13. Prior to setting of the packer 11, the receptacle is spaced downwardly of the expander head 13 so as to leave an annular void 40 between the expander head, the sealing ring 25 and the receptacle.

Figure 4:
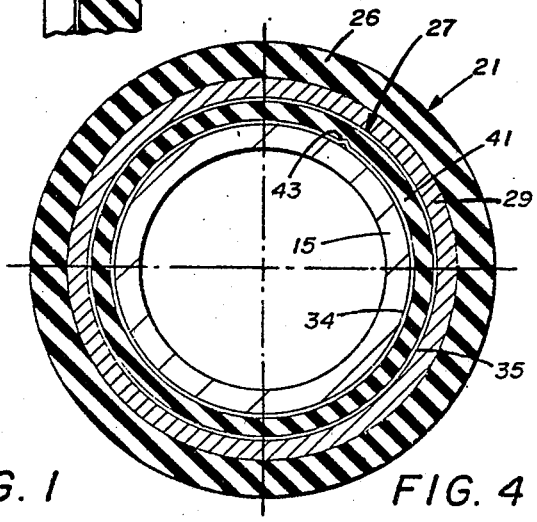
FIG. 4 is a view of the assembly taken substantially along line 4—4 of FIG. 3.

As shown in FIG. 2, the sleeve 21 includes an upwardly extending annular protrusion 41 which fits within the trough 37. Accordingly, when setting the packer, the receptacle deforms with some of the elastomeric material from the sleeve 21 flowing into the trough 37 and causing the inner and outer walls 34 and 35 of the receptacle 27 to move radially thereby substantially filling the void 40 and, in particular, causing the inner wall 34 to seal against the mandrel and thereby prevent the sleeve from extruding between the mandrel 15 and the expander head. In moving radially inward, the material forming the inner wall 34 buckles slightly leaving a small wrinkle 43 (see FIG. 4) at some point along the periphery of the mandrel. The size of the wrinkle, however, is less than that which would permit the extrusion of some of the elastomeric sleeve material along the mandrel. Preferably, the receptacle is formed of a malleable metallic material such as 10–18 carbon steel having a thickness of approximately 0.036 inches. A receptacle constructed of this material has been found to be deformed in the described manner with an applied setting force of approximately 30,000 lbs.

In view of the foregoing, it is seen that the present invention brings to the art a new and improved sealing assembly 10 particularly adapted for use in oil well packers 11 or the like and which advantageously enables construction of such packers without having to maintain extremely close clearance tolerances between the setting mandrel 15 and the expander heads 13 and 14. Advantageously, this is achieved by utilizing the unique malleable receptacles 27 which expand as the packer is set to seal against the mandrel and thereby prevent extrusion of the sleeve 21 between the mandrel and the expander heads.

The embodiments of the invention in which an exclusive property or privliege is claimed are defined as follows:

1. A sealing assembly for use in a packer to seal against the inside wall of a well casing when squeezed between longitudinally spaced expander heads on a packer mandrel when setting the packer, said assembly comprising, a generally cylindical elastomeric sealing element telescoped onto the mandrel between said expander heads and having opposite end portions, a sealing ring disposed between said expander head and said sealing element at each end thereof for expanding radially outward toward engagement with the inside wall of the casing to keep said element from extruding between the expander heads and casing when setting the packer, a substantially non-expandable retaining ring surrounding the mandrel adjacent each of said sealing rings and having one edge abutting said adjacent sealing ring and an opposite edge abutting said sealing element, an annular receptacle surrounding said mandrel and located between each of the expander heads and said opposite end portions of said sealing element, said receptacle having inner and outer malleable annular walls normally spaced radially outward from said mandrel with an end wall integrally connected therebetween so as to define an annular trough opening toward said sealing element, and a longitudinally extending annular protrusion integrally formed with said sealing element in each of said end portions and received within said troughs for deforming said inner walls radially inward into sealing engagement with said mandrel against elastomeric extrusion therebetween and for deforming said outer walls radially outward into sealing engagement with said retaining ring against elastomeric extrusion therebetween when setting said packer.

2. In a sealing assembly for a packer having longitudinally spaced expander heads on a mandrel movable toward each other when setting the packer to squeeze against opposite end portions of an element disposed therebetween to cause the element to seal against the inside wall of a well casing, the improvement comprising, an annular receptacle surrounding said mandrel and located between each of the expander heads and said opposite end portions of said sealing element, said receptacles having inner and outer malleable annular walls with an end wall integrally connected therebetween so as to define annular troughs opening toward said sealing element, said inner wall normally being spaced radially outward from said mandrel, said opposite end portions of said sealing element protruding into said troughs for deforming said inner walls radially inward into sealing engagement with said mandrel against elastomeric extrusion between the mandrel and the expander heads when setting the packer.

3. A sealing assembly as defined by claim 2 further including, annular expansible sealing rings disposed radially outward of said receptacles adjacent the opposite ends thereof for expanding radially outward toward engagement with the inside wall of the casing to keep said element from extruding between the expander heads and casing when setting the packer.

4. A sealing assembly as defined by claim 3 further including a substantially non-expandable retaining ring surrounding the mandrel adjacent each of said sealing rings and having one edge abutting said adjacent sealing ring and an opposite edge abutting said sealing elements, said outer wall of said receptacle being deformable by said sealing element toward engagement with said retaining ring when setting said packer to seal against extrusion of said element between said outer wall and said retaining ring.

5. An assembly as defined by claim 4 wherein said expander heads include facing end surfaces slanted away from each other at a preselected angle upon progressing radially outward from said mandrel, said end walls of said receptacles each including a section thereof slanted at substantially the same angle for abutting engagement with said end surface.

6. An assembly as defined by claim 2, 3, 4 or 5 including an annular void located between said expander heads and said receptacles prior to setting the packer, ssaid receptacles expanding to fill said voids when setting the packer.

7. A sealing assembly for use in a packer to seal against the inside wall of a well casing when squeezed between longitudinally spaced expander heads on a packer mandrel when setting the packer, said assembly comprising, a generally cylindrical elastomeric sealing element telescoped onto the mandrel between said expander heads and having opposite ends, an annular expansible sealing ring disposed between said expander head and said sealing element at each end thereof for expanding radially outward toward engagement with the inside wall of the casing to keep said element from extruding between the expander heads and casing when setting the packer, an annular receptacle surrounding said mandrel and located radially inward of said sealing ring and located between each of the expander heads and said opposite end portions of said sealing element said receptacle having inner and outer malleable annular walls normally spaced radially outward from said mandrel with an end wall integrally connected therebetween so as to define an annular trough opening toward said sealing element, a portion of each said opposite ends of said sealing element received within said troughs for deforming said inner walls radially inward into sealing engagement with said mandrel against rubber extrusion therebetween and for deforming said outer wall radially outward with said ring expanding against the casing to seal against extrusion of said element therebetween when setting said packer.

8. A sealing assembly for use in a packer to seal against the inside wall of a well casing when squeezed between longitudinally spaced expander heads on a packer mandrel when setting the packer, said assembly comprising, a generally cylindrical elastomeric sealing element telescoped onto the mandrel between said expander heads and having opposite ends, an annular expansible sealing ring disposed between said expander head and said sealing element at each end thereof for expanding radially outward toward engagement with the inside wall of the casing to keep said element from extruding between the expander heads and casing when setting the packer, an annular receptacle surrounding said mandrel and located radially inward of said sealing ring and located between each of the expander heads and said opposite end portions of said sealing element said receptacle having inner and outer malleable annular walls normally spaced radially outward from said mandrel with an end wall integrally connectd therebetween so as to define an annular trough opening toward said sealing element, an annular void located between said expander heads and said receptacles prior to setting the packer, a portion of each said opposite ends of said sealing element received within said troughs for expanding said receptacles so said inner walls move radially inward into sealing engagement with said mandrel against elastomeric extrusion therebetween and so said end walls engage said expander heads filling said annular voids and sealing against elastomeric extrusion between said heads and said receptacle when setting said packer with said sealing rings also expanding against the casing to seal against extrusion of said element along the inside wall of the casing.

* * * * *